United States Patent [19]

Roth

[11] Patent Number: 4,775,256

[45] Date of Patent: Oct. 4, 1988

[54] HAND-HELD PERSONAL HYGIENE DEVICE

[76] Inventor: Erich Roth, Otto-Balzer-Str. 29, 5427 Bad Ems, Fed. Rep. of Germany

[21] Appl. No.: 896,862

[22] PCT Filed: Dec. 12, 1985

[86] PCT No.: PCT/DE85/00522

§ 371 Date: Aug. 5, 1986

§ 102(e) Date: Aug. 5, 1986

[87] PCT Pub. No.: WO86/03664

PCT Pub. Date: Jul. 3, 1986

[30] Foreign Application Priority Data

Dec. 18, 1984 [DE] Fed. Rep. of Germany ..... 3446136

[51] Int. Cl.[4] ..... A46B 11/00

[52] U.S. Cl. ..... 401/28; 128/66

[58] Field of Search ..... 128/66; 401/28

[56] References Cited

U.S. PATENT DOCUMENTS

| | | | |
|---|---|---|---|
| 2,218,471 | 10/1940 | Hickey | 401/28 |
| 2,250,878 | 7/1941 | Quaranti | 401/28 |
| 2,325,758 | 8/1943 | Ferguson | 401/28 |
| 2,336,717 | 12/1943 | Crimmins | 401/28 |
| 2,379,330 | 6/1945 | Wilensky | 401/28 |
| 2,897,826 | 8/1959 | DiVito | 401/28 X |
| 2,922,425 | 1/1960 | Lerner et al. | 401/28 |
| 2,952,027 | 9/1960 | Caldwell | 401/28 |

*Primary Examiner*—Gregory E. McNeill

*Attorney, Agent, or Firm*—Wegner & Bretschneider

[57] ABSTRACT

Hand-held device for personal hygiene purposes dispensing a cosmetic and/or cleansing agent with an exchangeable container containing said agent, an exchangeable container being positionable within the hand-held device.

14 Claims, 3 Drawing Sheets

Figure 2:
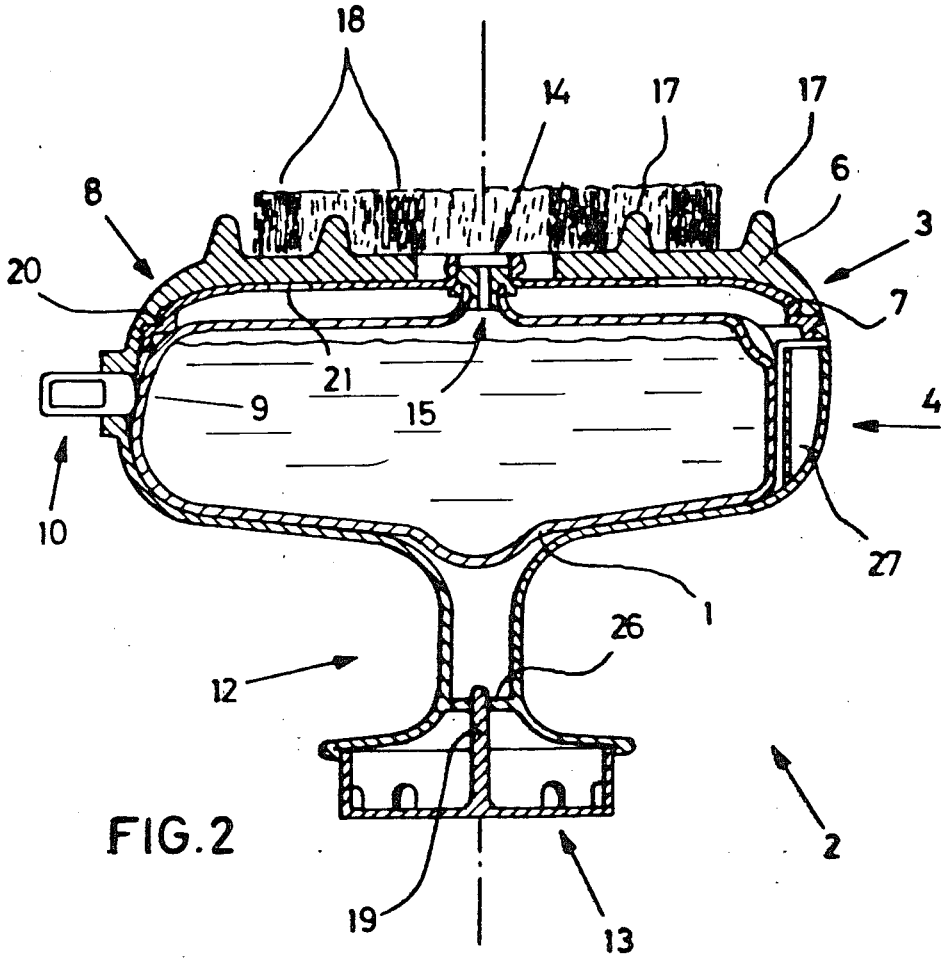

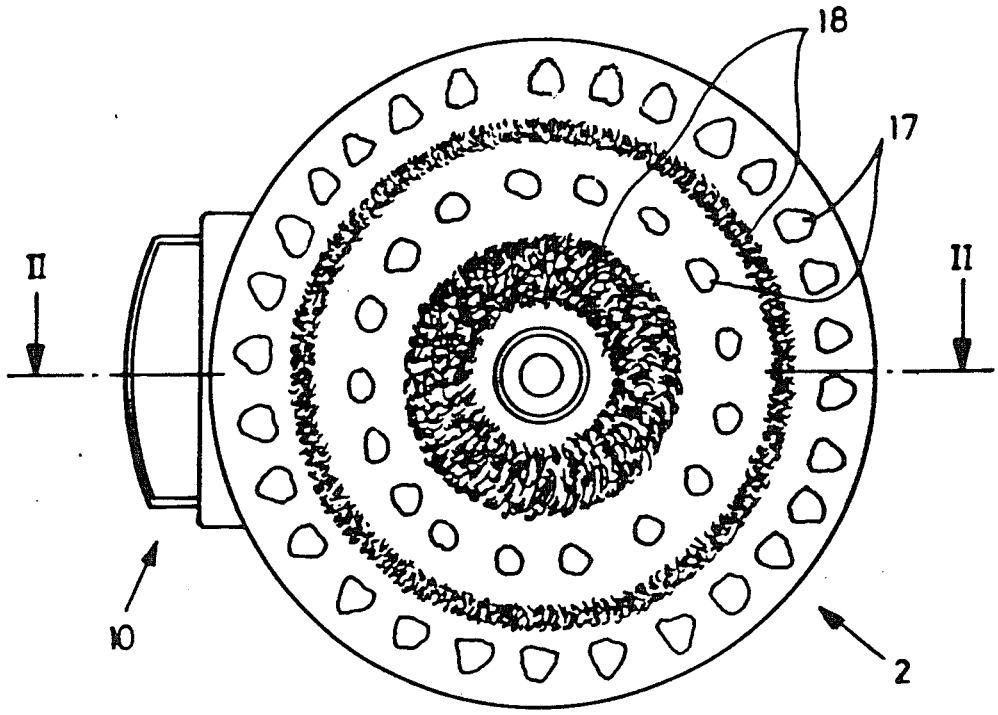
FIG.1
FIG.3
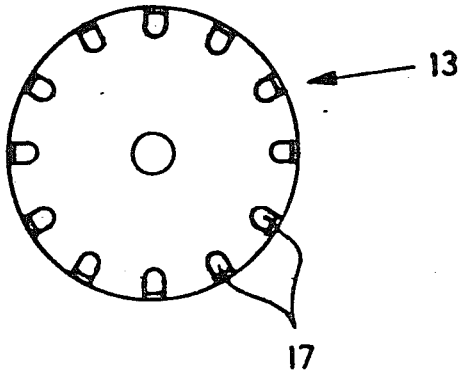
FIG.4
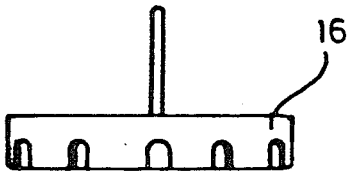

HAND-HELD PERSONAL HYGIENE DEVICE

The present invention relates to a hand-held device dispensing a cleansing and/or cosmetic agent for personal hygiene purposes with an exchangeable container containing the cleansing or cosmetic agent.

The presently described hand-held device is in particular a skin massaging device. This skin massaging device, which can also be called a washing and massaging device, makes it possible to clean and simultaneously massage the body, although the device is only to be used with regards to its massaging action.

A known device of the aforementioned type (cf. e.g. DE-AS No 27 49 156) comprises an exangeable container with a cap positionable thereon, which is made from a relatively flexible plastic and has burl-like formation. The change container is used for receiving the body cleansing and cosmetic agents in liquid form, which can pass through the fitted cap outwards on to the cap surface. The cap, which is made from a relatively flexible plastic, is provided with burl-like formations in such a way that the known hand-held device can be guided in a massaging and simultaneously cleansing manner over the skin in much the same way as a bar of soap. During the cleansing process, the user can bring about the discharge of cleansing or cosmetic agent by exerting pressure on the change container, which is also made from relatively flexible plastic. Moreover, the construction of the known hand-held device is such that during use, the user's hand substantially surrounds said container.

The construction of the new hand-held device and the functions allocated to the exchangeable container require the cap to be seated in a satisfactorily sealing manner on the exchangeable container, so as to prevent an escape of cosmetic or cleansing agent between cap and container. In addition, an exchangeable container must on the one hand be made from a relatively flexible material, so that the cleansing or cosmetic agent is discharged by compressing said container, but on the other hand the material must have an adequate strength to give the known hand-held device the overall physical structure. Thus, the use value or serviceability of the hand-held device is impaired or lost, if an exchangeable container is missing, e.g. because it has been thrown away, because it has to be replaced by a new an exchangeable container filled with cleansing or cosmetic agent.

The remaining cap cannot independently be used for massaging or the like and substantially has no use value without an exchangeable container. In addition, the change container must have a relatively complicated construction because, as stated, it has to fulfil a sealing, dispensing and handling function. Thus, a vital part of the known hand-held device must be replaced during each change process.

In view of the aforementioned characteristics of the known hand-held device, the problem of the presently described invention is to provide a device of the aforementioned type, which has a better utility and is simultaneously easier to change.

According to the invention this problem is essentially solved through the teaching of placing an exchangeable container within a hand-held device or to construct the latter in such a way that the container can be arranged therein.

According to this teaching a hand-held device is provided, in which an exchangeable container is relieved of the functions of having to essentially form the structure of the hand-held device and of having to be suitable for preventing a discharge of cosmetic or cleansing agent in the contact region between the cap and the an exchangeable container.

A further advantage is that the hand-held device according to the invention can be used without an exchangeable container for massaging and/or brushing the body, because in this respect its functionality is not dependent on the presence of an exchangeable container. The clear functional separation between an exchangeable container and hand-held device also makes it possible to construct the container in a relatively simple manner, particularly also in thin-walled manner, because during the use of the inventive hand-hand device, the container has no significance for the structure of said device.

In a development of the aforementioned teaching, a further inventive feature provides for the hand-held device to have a personal hygiene head and a gripping member, which are detachably interconnected. Advantageously this on the one hand gives access to the interior of the hand-held device, so that an exchangeable container can be fitted or removed and on the other hand the personal hygiene head can be individually removed and consequently optionally replaced, if e.g. there is a wish to use different personal hygiene heads or to carry out a replacement following a certain degree of wear.

According to a development an exchangeable container can be received in the gripping member, which is linked with the advantage that a relatively large space is available, so that it is possible to receive relatively large quantities of cleansing and cosmetic agent because the gripping member is naturally roughly adapted to the dimensions of a hand, which serves to guide it.

According to a further teaching of the invention, the personal hygiene head has shaped-out portions exerting a cleaning or similar action and formed from an elastic material, although the cleaning head overall has a substantially inflexible structure. This can be brought about in that in the case of a one-piece cleaning head, the basic structure is formed from a relatively rigid plastic, such as polystyrene, but the aforementioned shaped-out portions are made from a relatively flexible, skin-friendly plastic, such as silicone rubber or flexible polyethylene or the like, as well as rubber.

In a particularly preferred manner, the cleaning head comprises a covering and a structural member and the covering is secured in the marginal area of the structural member. The structural member can e.g. be secured by means of sealing lips formed on the covering and which engage in a corresponding sealing groove in the marginal area of the structural member. Apart from the advantage of a clear separation of processing of flexible and rigid material, such a two-part construction of the cleaning head has the advantage that, in accordance with its function, the structural member does not have to be a closed member and can indeed merely be constructed in strut-like or similar manner so as to provide the necessary shape. According to a practical realization of this teaching the structural member has a number of circular bores. Apart from reducing the material costs, such a structural member construction leads to the advantage that this provides a ventilation access to the interior of the hand-held device, particularly with the covering removed enabling any moisture which has penetrated to be dried.

The actual exchangeable container which, according to the invention can be arranged within the hand-held device is at least partly deformable, so that during use the cosmetic or cleansing agent can be dosed as a function of the action on the deformable area, i.e. can be discharged in suitable quantities. Fundamentally the hand-held device and preferably the gripping member could have corresponding shaped-out portions enabling direct action to take place from the outside on the exchangeable container. However, according to an advantageous development a flow regulator displaceable in the interior of the hand-held device is provided for acting on the exchangeable container. Thus, when using the hand-held device, by the action of a thumb of the hand guiding the device pressure can be exerted on the flow regulator, so that a suitable cleansing or cosmetic quantity is discharged. As a result of the flow regulator, it is possible to construct the hand-held device and in particular the gripping member in closed manner, so that the user's hand only engages externally on said device, thereby excluding unintentional action on the change container. As the flow regulator cooperates with the deformable area of the change container, automatic restoring of the flow regulator occurs, so that there is no need for spring loading or the like of the flow regulator for moving it back into its initial position.

Advantageously the flow regulator is arranged in an upper marginal area of the gripping member associated with the personal hygiene head, because this leads to a favourable operating position, e.g. for the thumb of an engaging hand. In addition, the flow regulator has no prejudicial action either during the personal hygiene process, or when holding or guiding the hand-held device.

According to another teaching of the presently described invention, the hand-held device is constructed with a base, so that on the one hand it can be set down independently of a depositing container or the like and on the other hand if the base is suitably constructed in can be hung in a loop holding means or the like. To prevent any impeding of the gripping hand during the handling of the present hand-held device, according to a preferred solution the base is constructed in glass handle-like manner, so that the device can be gripped in much the same way as a chalice, the glass handle-like region of the base being held between two fingers, e.g. the index and middle finger. This not only avoids any interference by the base on gripping the hand-held device, but advantageously permits a more reliable gripping and guiding of said device. It in particular substantially prevents a sliding out of the guiding hand of the hand-held device under moist or soapy-slippery conditions.

The exchangeable container of the hand-held device according to the invention must obviously initially be closed, i.e. before insertion in the said device, so as to reliably prevent a discharge of cleansing and cosmetic agent during sale and distribution, but after placing in the device a container with constant opening is inappropriate, because increased consumption would result from the drying up of the cleansing and cosmetic agent.

To solve this problem, according to a further construction of the invention, the exchangeable container has a removable, spiked disposable stopper, which is removed prior to the first use of the device. Preferably this disposable stopper is provided with a relatively small diameter gripping area, so that the disposable stopper can still be removed from the change container after the latter has been placed in the hand-held device, namely through a dispensing opening provided in the device and preferably in the personal hygiene head and against which internally engages the discharge opening of the exchangeable container when the hand-held device is in the use state.

When the disposable stopper has been removed for the first time, it is necessary to provide an independent closing possibility for the discharge opening or dispensing opening. According to a further teaching of the invention, a plug is provided for this purpose, which can be put aside during the use of the hand-held device. However, it is preferable for the plug to be received in the base of the hand-held device during the use of the latter. Following use of the device, the plug can be removed from the base, where it is mainly held by means of a long closing pin in a corresponding bore and it can then be mounted on the personal hygiene head.

For this purpose, the plug preferably has a relatively large diameter cover surface on which the plug can easily be engaged but which, after being fitted on to the cleaning head, also takes over the function of at least partly covering the cleaning head in the vicinity of the dispensing opening. Burl and/or brush regions formed in this area of the cleaning head or covering can be covered for protection purposes when the hand-held device is not in use. Since in according with the main use of the hand-held device, these areas are moist following the end of use, the cover surface of the plug is provided with shaped-out portions, which permit an unhindered drying of these areas.

As has already been indicated, according to a further development of the inventive hand-held device, the latter or preferably the covering has burl and/or brush areas, which are suitable for both massaging and brushing the skin or body. In particular these burl and/or brush areas, but preferably the complete covering, are made from a skin-friendly flexible plastic, such as silicone rubber or flexible polyethylene, as indicated hereinbefore. A particular advantage of the brush areas is their foam-aiding action. The brush areas very effectively aid the production of cleaning foam on the body, following the discharge of a corresponding agent from the dispensing opening by operating the flow regulator.

The burl and/or brush areas are preferably constructed in circular manner, preferably alternately on the personal hygiene head and covering, particularly if the complete hand-held device (with the exception of the flow regulator) is constructed axially symmetrically to a vertical central axis, as can be gathered from the drawings. With regards to the reception of the exchangeable container within the hand-held device according to a further development of the invention the device is internally provided with a centring cam, which is particularly advantageous for a positionally reproducible insertion of the exchangeable container in the hand-held device or more precisely in its gripping member, if in preferred manner the exchangeable container is only partly made from a particularly flexible plastic, namely that part in which it cooperates with the flow regulator. It is clear that it is then necessary to always place the exchangeable container in the same way in the gripping member. Advantageously the exchangeable container can also have a centring recess, mainly to show which area is to be associated with the centring cam. However, there is no need for such a centring recess, because as a result of the relatively flexible material for the complete exchangeable container the latter can in the vicinity of the centring cam undergo shape-adaptation thereto.

Further advantageous details of the invention can be gathered from the following description of an embodiment illustrated by the attached drawings, which:

FIG. 1 A plan view of the hand-held device according to the invention.

FIG. 2 A section through the hand-held device according to the invention along line II—II in FIG. 1.

FIG. 3 A plan view of the plug.

FIG. 4 A side view of the plug shown in FIG. 3.

Figure 5:
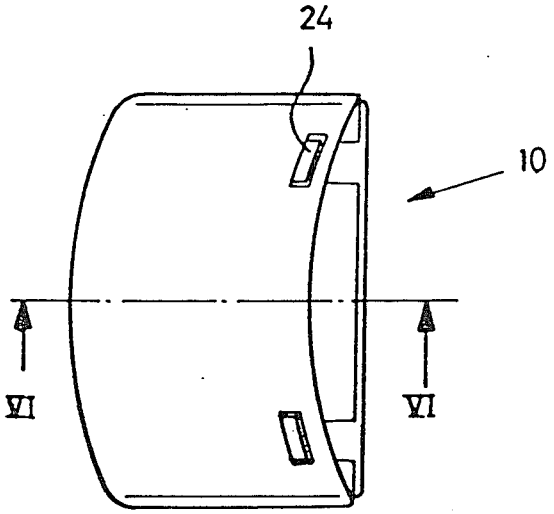

FIG. 5 A detail of the flow regulator.

Figure 6:
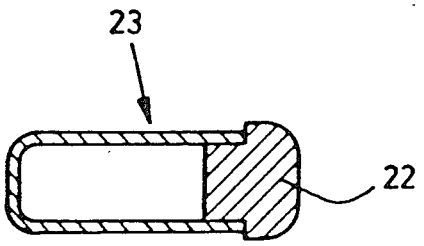

FIG. 6 A section through the flow regulator according to FIG. 5 along line VI—VI.

Figure 7:
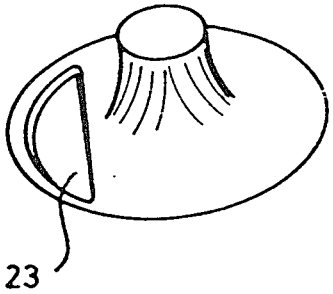

FIG. 7 A perspective view of the base area of the hand-held device with the plug removed.

What is represented and shown is a hand-held device 2 in which is arranged an exchangeable container 1. The hand-held device 2 is used for cleaning, massaging, brushing, etc. of the body and to this end is provided in its upper region with burl and brush areas 17, 18. A user can grip the hand-held device 2 with one hand from the bottom at base 12, in such a way that, in much the same way as a glass handle, he will grip the narrowed portion of base 12 e.g. between the index and middle finger and in particular the device is placed in his hand in such a way that he can operate the flow regulator 10 with this thumb, so that the cleansing and/or cosmetic agent in the container is discharged from the discharge opening 15 thereof or the dispensing opening 14 of the personal hygiene head 3 of the hand-held device 2. The cleansing and/or cosmetic agent or liquid can in particular be a shower gel or skin care gel.

As can be seen in FIG. 2 and particularly FIGS. 3 and 4, in the case of the presently represented hand-held device a plug 13 is provided, which can be placed on the personal hygiene head 3 or more accurately the dispensing opening 14 after using the device, so that by means of its closing pin 19 discharge opening 15 of container 1 is closed.

As can be seen, plug 13 has a cover surface 16 for covering the brush area 18 of cleaning head 3 immediately adjacent to dispensing opening 14 when hand-held device 2 is not in use. Opening 17 provided in the plug 13 make it possible to dry any moisture in the brush areas 18 on covering by means of plug 13.

As can be gathered from FIG. 2, the exchangeable container 1 is received within a gripping member 4, which is detachably connectable with the personal hygiene head 3 and, as the drawing shows, head 3 can be screwed by means of a thread formed therein into gripping member 4 by means of a corresponding counterthread therein.

Cleaning head 3 comprises a structural member 7 and a covering 6, which is provided with sealing lips 20 for securing it in the marginal area 8 of structural member 7. Structural member 7 also has recesses 21, which on the one hand reduce the weight of structural member 7 made from relatively inflexible plastic, but on the other hand permits easy drying of any moisture which has penetrated between member 7 and covering 6.

Flow regulator 10 makes the exchangeable container 1 deformable, the latter being made from the elastic plastic at least in the area associated with the regulator, so that it has a deformable region 9. Thus, as a function of the deformation, cleansing and cosmetic agent is discharged in metered manner through discharge opening 15 or dispensing opening 14.

Flow regulator 10 is shown in detail in FIGS. 5 and 6, where it is clear that it comprises a sliding head 22 and a displacement zone 23. The latter is constructed in hollow body-like manner and like the remainder of hand-held device, with the exception of covering 6, is made from a relatively rigid plastic, such as polystyrene, whereas the sliding head 22 is made from a more flexible plastic, in order to protect exchangeable container 1 during operation. Sliding head 22 is fixed in the sliding zone 23 by means of retaining cams 24, as can be seen in FIG. 5.

Base 12 of hand-held device 2 is separately shown perspectively in FIG. 7 with plug 13 removed, it being possible to see a recess 25, with the aid of which device 2 can be hung up after use, e.g. on a hook or the like. In the same way after use, the hand-held device 2 can also be set down on base 12 with plug 13 removed, just as when plug 13 is inserted in base 12, or more precisely the retaining bore 26.

As can in particular be gathered from FIGS. 1 and 2, the hand-held device is essentially axially symmetrical with respect to a vertical central axis, with the exception of flow regulator 10. As can be gathered from FIGS. 1 and 2, this leads to an appropriate attractive shape, which is also linked with the advantage that corresponding injection moulds for production purposes can be less expensively produced than in the case of very irregular shapes.

The drawings show that a centring cam 27 is provided relative to the exchangeable container 1, which can cooperate with a corresponding centring recess in said container. However, there is no need for the centring recess, if in the region associated with the centring cam 27, exchangeable container 1 is also made from a relatively flexible, deformable plastic.

The features of the invention disclosed in the description, drawings and claims can be essential to the realization of the different variants of the invention, either singly or in random combinations.

We claim:

1. Hand-held device for dispensing a cosmetic and/or cleansing agent for personal hygiene wherein said cosmetic or cleansing agent is contained in an exchangeable container, characterized in that the exchangeable container is arranged in the interior of the hand-held device which is of substantially rigid structure and in that the exchangeable container is at least partially deformable so that, in use, the cleansing or cosmetic agent can be dosed as a function of the deformable portion of the exchangeable container.

2. Hand-held device according to claim 1, characterized in that the hand-held device has a personal hygiene head and a gripping member, which are detachably interconnectable.

3. Hand-held device according to claim 2, characterized in that the change container can be received in the gripping member.

4. Hand-held device according to claim 1, characterized in that the personal hygiene head has shaped-out portions for exerting a cleaning or similar action, which are formed from an elastic material, whereas the complete cleaning head has a substantially inflexible structure.

5. Hand-held device according to claim 4, characterized in that the cleaning head comprises a covering and a structural member and that the covering is held in a marginal area of structural member.

6. Hand-held device according to claim 1, characterized in that, for acting on the exchangeable container, hand-held device has a flow regulator displaceable in the interior of the latter.

7. Hand-held device according to claim 6, characterized in that, the flow regulator is mounted in gripping member in an upper marginal area associated with the personal hygiene head.

8. Hand-held device according to claim 1, characterized in that a base is formed on hand-held device.

9. Hand-held device according to claim 8, characterized in that the base is constructed like a glass handle.

10. Hand-held device according to claim 1, characterized in that the hand-held device has a plug preferably receivable in base during use and enabling the closing of a dispensing opening in the personal hygiene head.

11. Hand-held device according to claim 10, characterized in that the plug is provided with a cover surface.

12. Hand-held device according to claim 1, characterized in that a discharge opening for exchangeable container tightly engages on the dispensing opening of the personal hygiene head in the use state.

13. Hand-held device according to claim 1, characterized in that the hand-held device has burl and/or brush areas.

14. Hand-held device according to claim 13, characterized in that the burl and/or brush areas are constructed in circular and preferably alternate manner.

* * * * *